United States Patent [19]

Shrum

[11] 4,207,941

[45] Jun. 17, 1980

[54] METHOD OF CONTINUOUS CASTING OF METAL IN A TAPERED MOLD AND MOLD PER SE

[76] Inventor: Lorne R. Shrum, 820 Manchester Rd., London, Ontario, Canada, N6H 4J6

[21] Appl. No.: 815,261

[22] Filed: Jul. 13, 1977

Related U.S. Application Data

[63] Continuation of Ser. No. 694,952, Jun. 11, 1976, abandoned.

[30] Foreign Application Priority Data

Jun. 16, 1975 [GB] United Kingdom ..... 25542/75

[51] Int. Cl.[2] ..... B22D 11/00

[52] U.S. Cl. ..... 164/82; 164/418

[58] Field of Search ..... 164/82, 122, 418, 441, 164/4

[56] References Cited

U.S. PATENT DOCUMENTS

| | | | |
|---|---|---|---|
| 3,226,782 | 1/1966 | Schultz | 164/418 X |
| 3,563,298 | 2/1971 | Stauffer et al. | 164/418 X |
| 3,765,472 | 10/1973 | Rossi | 164/441 X |

*Primary Examiner*—Robert D. Baldwin
*Assistant Examiner*—Gus T. Hampilos
*Attorney, Agent, or Firm*—Ridout & Maybee

[57] ABSTRACT

A mould for the continuous casting of metals is formed with sections having different tapers so as to match the peripheral contraction of the mould to contraction of the metal being cast at different stages of the casting process. In an intermediate section of the mould in which the metal forms a peripheral shell, a peripheral contraction is applied which is preferably about 30–40% of the linear shrinkage of the metal on freezing, while a considerably more gradual taper is applied in an exit section.

12 Claims, 2 Drawing Figures

METHOD OF CONTINUOUS CASTING OF METAL IN A TAPERED MOLD AND MOLD PER SE

This is a continuation, of application Ser. No. 694,952, filed June 11, 1976, now abandoned.

FIELD OF THE INVENTION

This invention relates to methods and moulds for use in the continuous casting of metals, particularly although not exclusively steel.

REVIEW OF THE PRIOR ART

In the continuous casting process, molten metal is poured into and passes downwardly through a cooled tubular mould within which at least an outer shell of the metal is solidified to form a casting of a desired cross-section emerging from the lower end of the mould, whereafter the casting is further cooled to reduce the casting to a temperature suitable for subsequent handling.

In order to function properly for this purpose, the tubular moulds employed must be very effective in absorbing heat from the molten metal, and for this reason water cooled copper moulds are normally employed.

Castings made in such moulds tend to exhibit surface defects, and defective structure in their surface layers, and my investigations have indicated that this is due to the molten metal contracting away from the walls of the mould as it freezes in contact with the latter, the skin of metal thus formed then breaking down or deforming to allow further partial contact with the mould. Moreover, the skin of solidifying metal becomes distorted, tending in the case of angular moulds to be pulled away from the corners of the mould whilst bulging towards the walls of the mould along the sides of the latter, leading to uneven cooling, uneven wear of the mould and excessive friction. These problems tend to produce a casting of which the surface portions are defective in several respects. Moreover, contact between the mould and the casting is very imperfect and largely restricted to the initial solidification zone where the skin of metal first forms on the mould walls.

In an attempt to compensate for the contraction of the metal during cooling, moulds continuously tapered from top to bottom have been proposed and used. However, these have not solved the problems outlined above.

The primary purpose of such tapers has been to improve contact between the solidifying metal and the mould walls, in order to improve the conduction of heat from the metal, but the degree of improvement in this respect has been somewhat limited. It is highly desirable that the casting rate of such molds be increased as much as possible, since at the moment, they tend to determine the running speed of a continuous casting line, and for this purpose, more effective conduction of the heat of the metal into the mould is required.

SUMMARY OF THE INVENTION

The object of the present invention is to provide moulds for the continuous casting of metals, typically steel, which enable higher casting rates and/or the production of an improved quality casting.

According to the invention there is provided a method of continuously casting a metal comprising passing the metal through a cooled tubular copper mould so that the metal is formed successively into a meniscus of molten metal whilst passing through an entry section, and into a solidified shell of sufficient rigidity to withstand the ferrostatic pressure of the still molten metal within the shell whilst being subjected to the containing action of an intermediate section having an internal cross-sectional periphery which contracts along the length of the said section, by between 25% and 60% of the linear solidification shrinkage of the metal being cast and cumulatively less than the peripheral shrinkage of the shell formed therein, is further cooled on passage through an exit section having a cross-sectional periphery contracting at a rate not exceeding the rate of peripheral contraction of the shell as it passes through the exit section. The contraction of the intermediate section is preferably between 30% and 40% of the of linear solidification shrinkage of the metal.

According to a further aspect of the invention, a tubular copper mould for the continuous casting of metals comprises an entry section, in which when the mould is in use a meniscus defining the top level of metal poured into the mould may be established, an intermediate section of reducing internal cross-sectional periphery extending downwardly from the entry section, the total degree of reduction in the internal cross-sectional periphery of the section being equal to between 25% and 60%, and preferably 30% and 40%, of the linear solidification shrinkage of the metal being cast, the length of this intermediate section being approximately sufficient at the intended speed of casting through the mould to enable a solidified shell of metal to be formed of sufficient rigidity to withstand the ferrostatic pressure of the still molten metal within the casting, and an exit section beneath the intermediate section, the exit section having a cross-sectional periphery which is further reduced at a rate not exceeding the rate of peripheral contraction of the shell as it passes through the exit section of the mould when in use.

In practice, the aim is to profile the mould so that its cross-sectional periphery is reduced along its length to match so far as practicable the peripheral contraction of the metal being cast within at different stages in the casting process. In order that the mould may operate properly, the cumulative reduction in cross-sectional periphery at any point must not exceed the cumulative peripheral contraction of the casting at that point, and in practice a somewhat lower amount of reduction will be necessary to provide flexibility and allow for fluctuations in operating parameters. The degree of support afforded to the metal during solidification, and the efficieny of heat transfer from the metal to the mould will be related to the closeness with which the reduction in cross-sectional periphery of the mould matches the contraction of the metal. In practice, advantageous results will be obtained if the intermediate section provides a degree of peripheral contraction which amounts to between 25% and 60% of the theoretical peripheral contraction due to linear solidification shrinkage of the metal being cast upon freezing. The rate of reduction in the exit section must be substantially less than the rate of reduction in the intermediate section so as not to exceed the rate of peripheral contraction of the metal once solidified. The reduction in cross-sectional periphery of the intermediate section will be at a rate greater than is practicable in conventional continuously tapered moulds; the adoption of rates of reduction as great as suggested above in moulds with a continuous uniform taper leads to the casting failing to pass through the mould, since the rate of taper in the lower part of the mould exceeds the rate of shrinkage of the metal.

BRIEF DESCRIPTION OF THE DRAWINGS

The invention is described further with reference to the accompanying diagrammatic drawing in which.

DESCRIPTION OF THE PREFERRED EMBODIMENTS

Figure 1:
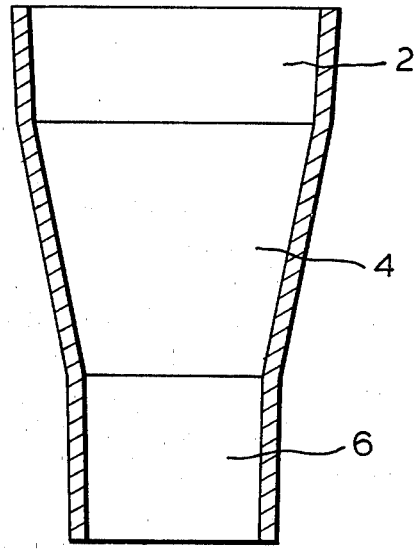
FIG. 1 shows a vertical cross-section through a mould in accordance with the invention with straight tapered section, features of the configuration of the mould being greatly exaggerated for the sake of illustration.

Referring to FIG. 1, the mould M is formed from copper, preferably by the explosive forming method described in my U.S. Pat. No. 3,927,546, which method is well suited to producing moulds of any desired longitudinally varying internal profile. In this technique, a copper sleeve is explosively formed onto a mandrel having an outside profile complementary to the desired inside profile of the mould to be formed. p The mould as shown has three sections, an entry section 2, an intermediate section 4 extending downwardly and tapering inwardly from the entry section, and an exit section 6 extending downwardly and tapering inwardly from the first tapered section, the taper of the exit section being less than that of the tapered section 2. When installed, the outer surface of the mould is water cooled.

The exact profile of the entry section is not critical, although it should be selected to facilitate reception of molten metal from a tundish, and also to facilitate removal of solidified metal from the mould in the event that casting is halted for any reason. In practice, a parallel or slightly tapered profile is likely to provide the best results. The length of the entry section is selected so as to accommodate the meniscus of the poured metal during operation sufficiently above the top of the tapered section 2 for solidification to commence close to the top of said tapered section. The length of the intermediate section is selected so that before it leaves the bottom of the section, the metal has developed a coherent solidified skin of sufficient thickness to withstand the ferrostatic pressure of the still molten metal within the casting. As the metal being cast solidifies, it undergoes a shrinkage characteristic of that metal, and I have found that if, during formation of the solidified skin referred to above, the metal is passing through a section of the mould which has a degree of contraction in its internal cross-sectional periphery which is a substantial proportion of the linear solidification shrinkage of the metal concerned upon freezing, contact between the metal and the mould is substantially improved, and the surface quality and uniformity of the casting can also be much improved. The rate of peripheral contraction required in the section 2 of the mould will be greater, and preferably substantially greater than that used in previous continuously tapered moulds, in which the rate of taper could not exceed the rate of contraction of the metal subsequent to formation of a solidified skin of such substantial mechanical strength as could cause the casting to jam in the taper.

In the present invention the exit section is also inwardly tapered, but only to such a degree that the resulting peripheral contraction does not exceed the rate of contraction of the casting as it cools. Such a taper improves the rate of cooling of the casting, and provides extra support for the casting at a time when it still comprises relatively thin walls surrounding a liquid core. The improved rate of cooling in this section and the preceding section can enable the total length of the mould to be shortened substantially for a given rate of casting, or alternatively enable the rate of casting to be increased substantially.

The optimum lengths of the various sections will vary according to the properties of the metal being cast, such as its solidification shrinkage, and the range of temperature over which solidification occurs, the rate of casting required and the desired total length of the mould. In a mould produced in accordance with the invention for the casting of steel, the entry section was 10.2 cm long, the tapered section 31.8 cm long, and the exit section 38.4 cm long, making a total of 80.4 cm, similar to that of the conventional mould which it replaced. In this case the exit section was considerably longer than was really necessary in order to provide a mould of a convenient total length, and with a suitable taper in the exit section to provide efficient heat transfer, a length of ten centimeters or so for this section would have been sufficient.

The limiting factor in reducing the length of the exit section is the necessity to provide accommodation for a dummy bar and seal, and actuating mechanism for the dummy bar, which is inserted into and then withdrawn from the bottom of the mould as a cast is started. In most cases a 10 to 15 cm length will be sufficient for this purpose. There will not necessarily be a sharp transition from the intermediate to the exit section. Whilst both these sections may be formed with constant tapers, in certain cases at least a better match to the contraction of the metal may be obtained by using varying rates of peripheral contraction along the lengths of the sections, and a gradual transition between the sections.

It should be understood that the mould need not necessarily be straight, curved moulds being frequently used so that the casting emerges from the mould with a horizontal component of motion. Moreover the cross-sectional shape of the mould will vary according to the shape of casting required, and may be for example of round, square, rectangular or 'dog-bone' cross-section.

The invention is further illustrated by the illustrative and comparative examples set out in the table below, in which Examples A and B were conventional square cross-section untapered and continuously tapered moulds used as controls, 80.3 cm long and having internal cross-sectional dimensions at its bottom end of 13.34 cm × 13.34 cm. Examples C and D were moulds in accordance with the invention, having the same cross-sectional dimensions at their bottom end, and entry sections and continuously tapered intermediate and exit sections at the lengths set out in the previous paragraph. Examples E, F and G represent examples of continuously tapered moulds in commercial use, and having various lengths, whilst Example H, I, J, K and L are previously reported experimental moulds having continuous tapers.

TABLE

| Mould | Section | % Taper/cm | Total Peripheral Contraction Per Section (cm) | Degree of Peripheral Contraction of Intermediates Section as % of Linear Coefficient of Solidification Shrinkage of Steel (see note [b]) | Total Peripheral Contraction of Mould (cm) | % Increase In Rate of Heat Transfer, Referred to Example A |
|---|---|---|---|---|---|---|
| A | | 0.000 | | | 0.00 | 0 |
| B | | 0.0072 | | | 0.30 | 4 |
| C | Intermediate | 0.0183 | 0.80 | 30% | 0.40 | 11 |
| | Exit | 0.0051 | 0.10 | | | |
| D | Intermediate | 0.0366 | 0.60 | 60% | 0.80 | 25–37 |
| | Exit | 0.01 | 0.20 | | | |
| E | | 0.014 | | | 0.64 | |
| F | | 0.0095 | | | 0.35 | |
| G | | 0.0055 | | | 0.20 | |
| H | | 0.0105 | | | 0.44 | |
| I | | 0.0153 | | | 0.64 | |
| J | | 0.0183 | | | 0.76 | (see note[a]) |
| K | | 0.016 | | | 0.66 | |
| | | | (see note[b]) | | | |

[a]This mould failed to function since the casting would not move through it.
[b]The linear contraction of the steel on solidification is equivalent to 0.25 cm over a distance of 13.34 cm, corresponding to a linear solidification shrinkage of $1.9 \times 10^{-2}$, and a contraction of 1 cm in the periphery of a square mass of steel 13.34 cm by 13.34 cm.

The performance of moulds C and D represents a substantial improvement over moulds A and B, the tests all being carried out at the same rate of casting; the improved heat transfer achieved by moulds C and D means that in the former case at least the rate of casting could be substantially increased, thus improving productivity. Even quite a small increase in the maximum casting rate can be significant commercially, and the present invention offers the potential of substantial increases in casting rate, particularly since the rate of heat transfer will further increase with increasing casting speed. In the case of mould D, there was evidence that the degree of peripheral contraction (60% of the linear solidification shrinkage, i.e. about 1% of the internal periphery of the mold and a rate of reduction of 0.036%/cm of mold length) applied in the intermediate section was close to the maximum practicable, taking into account the variations in operating parameters inevitable in a practical continuous casting process and the problems in commencing a cast. When the degree of peripheral contraction in the intermediate section was increased to 70% of the linear solidification shrinkage of the steel, (i.e. about 1.3% of the internal periphery of the mold) the casting would not move reliably through the mould, which was therefore unacceptable. At the other end of the range, a peripheral contraction of less than about 25% (i.e. about 0.5% of the internal periphery of the mold and a rate of reduction of 0.015%/cm of mold length) may show little advantage over a continuously tapered mould. The most advantageous range in practical applications appears to be 30% to 40% contraction. (i.e. about 0.56% to about 0.75% of the internal periphery of the mold)

Figure 2:
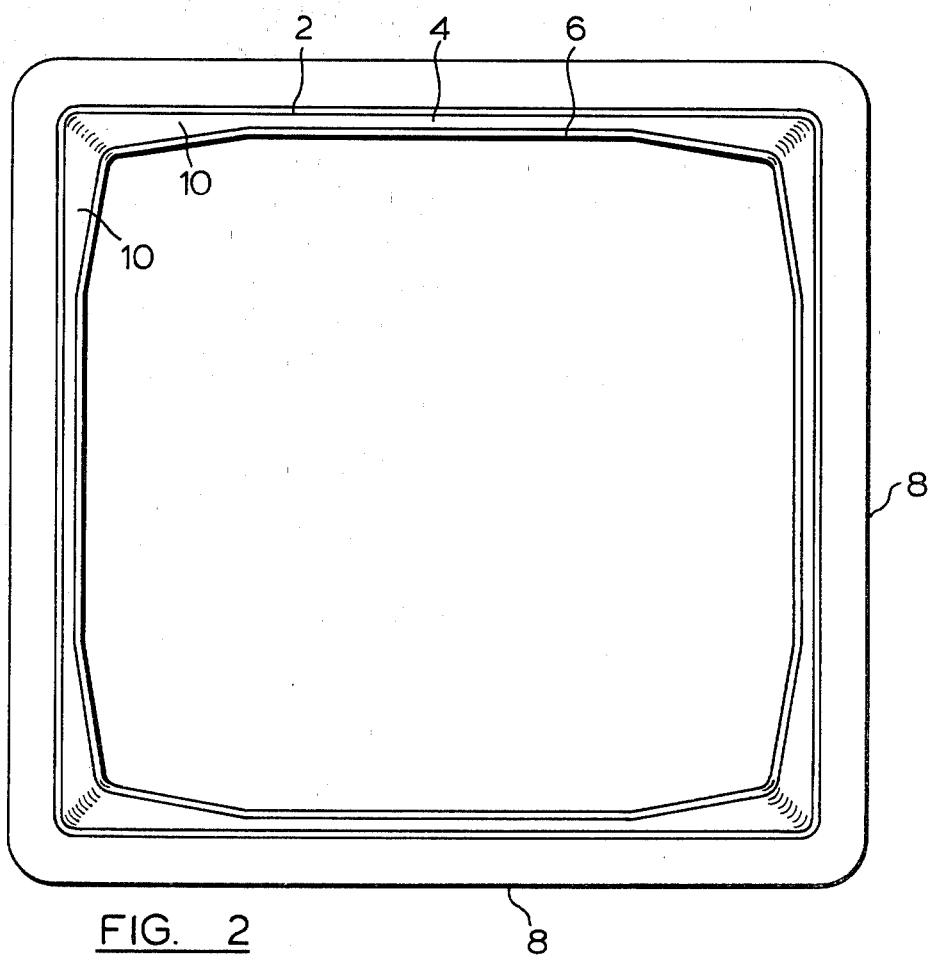
FIG. 2 is a plan view of a further embodiment of mould, with similar exaggeration.

The contraction of the internal cross-sectional periphery of the mould in the intermediate section need not necessarily be achieved by uniform tapering of the linear cross-sectional dimensions of the mould. A non uniform rate of taper may be found advantageous in some cases, and it can also be advantageous for the contraction to be concentrated at certain portions of the mould periphery as indicated in FIG. 2, in which in a square mould the contraction is concentrated at the corners. This more closely matches the natural pattern of contraction of a casting of this shape, and reduces friction between the casting and the moulding walls thus improving the life of the mould as well as providing more uniform heat transfer between the casting and the mould. In a typical mould of the type shown in FIG. 2, the entry section of the mould is of square cross section, with slightly radiused corners, and the entire walls 8 of the mould have a slight uniform inward taper from top to bottom except adjacent the corners of the intermediate and exit zones. In the intermediate zone, the mould has facets 10 of progressively increasing width formed adjacent the corners and angled slightly inwards relative to the remainder of the walls, so that the angles of the mould corners become slightly obtuse. No further widening of the facets takes place in the exit zone 6, the overall taper of the mould being selected so as to provide the desired rate of constraction in the exit section. In a typical example of such a mould having a nominal cross section of 13.6 cm square, the entry section is 15.2 cm long, the intermediate section is 26.6 cm long and the exit section was extended to 38.6 cm to give a total length of 80.4 cm to suit an existing continuous casting installation. The overall taper of the mould is 0.025 cm over the length of the mould, and the width of each of the facets 10 in the intermediate section widens from 0 to 2.5 cm, the angle between the facets at each corner being 91° 44'. This results in a contraction of the internal cross-sectional periphery of the mould by 0.30 cm over the length of this section of the mould due to the facets and a further 0.033 cm due to the overall mould taper, giving a total of 0.33 cm as compared to a theoretical peripheral contraction (over the same dimensions) of steel on freezing of 1 cm. The degree of peripheral contraction of the intermediate section is therefore 33% of the linear solidification shrinkage of the steel.

The shaping of the mould as described above results in the sides of the mould through the intermediate section becoming effectively slightly and increasingly convex and it is this feature (of increasing convexity) which is believed to assist in lowering friction and improving the uniformity of heat transfer. It will be understood therefore that modified mould configurations providing the necessary peripheral contraction whilst increasing the convexity of the mould walls may also be used. Indeed, it would be possible to use a mould in which the walls at the entry were concave, an effective increase in convexity being provided by reducing or eliminating the concavity of the walls through the intermediate section. The necessary effect may be achieved by concentrating the contraction, in the inner cross-sectional periphery, adjacent the corners of the mould.

An advantage of the embodiment described with reference to FIG. 2 arises from the continuous taper of the sides. This assists manufacture of the mould by the process described in U.S. Pat. No. 3,927,546 because the taper, which is of course present in the mandrel used to form the mould, facilitates the positioning over the mandrel of a copper sleeve to be formed, whilst at the same time providing a desired degree of taper in the entry and exit sections of the mould.

Moreover, the mandrel itself is easily formed to provide any desired degree of peripheral contraction in the intermediate section by forming a uniformly tapered mandrel and cutting facets of appropriate dimensions adjacent its corners using an angled cutter, which may also be used to radius the corners of the mandrel, moving longitudinally along the corners so as to achieve the desired reduction in the peripheral cross-section of the mandrel and hence the mould.

What I claim is:

1. A method for the continuous casting of metals in a tubular copper mold comprising:

providing a substantially vertically oriented continuous casting mold having an entry section in which, when the mold is in use, a meniscus defining the top level poured into the mold may be established, a first tapered section of continually decreasing internal periphery extending downwardly from the entry section and a second tapered section extending directly from the lower end of the first tapered section, the second tapered section having an internal periphery continually decreasing at a lesser rate of reduction than a rate of reduction of said first tapered section;

pouring metal into said mold to establish the meniscus in the entry section, said metal having a linear solidification shrinkage value, the total degree of reduction in the internal periphery of the first tapered section being equal to between 25% and 60% of the linear solidification shrinkage value of the metal being cast;

withdrawing the casting from the mold at a rate to enable a solidified shell of metal to be formed in the first tapered section of sufficient rigidity to withstand the ferrostatic pressure of the still molten metal within the casting;

said withdrawing of the casting being such that the rate of external peripheral contraction of the shell as it passes through the second tapered section of the mold is greater than the rate of internal peripheral reduction of said second tapered section and such that the rate of external peripheral contraction of the shell as it passes through the second tapered section is less than the rate of internal peripheral reduction of the first tapered section, and said withdrawing of the casting being such that the cumulative reduction of the internal periphery of the mold at any location along the length of the first and second tapered sections of the mold is less than the cumulative reduction of the external periphery of the casting formed therein at said location.

2. A method according to claim 1, wherein the total degree of reduction of the internal periphery of the first tapered section is between 30% and 40% of the linear solidification shrinkage of the metal being cast.

3. A method according to claim 1, wherein the first tapered section is uniformly tapered.

4. A method according to claim 1, wherein the mold in cross-section has corners, and the higher rate of reduction of the internal periphery of the first tapered section results from progressively changing the internal profile of the corners.

5. A method according to claim 4, wherein in the first tapered section, the walls include corner facets and portions of the walls between the corner facets which have a uniform inward taper from top to bottom, the corner facets being of progressively increasing width along the length of the first tapered section, being formed adjacent the corners and being angled inward relative to the remainder of the walls so that the angles of the corners are increased.

6. A method according to claim 5, wherein the corner facets are continued through the second tapered section without further widening.

7. In a tapered tubular copper mold for the continuous casting of steel wherein said mold has an open top end and an open bottom end, an entrance section integral with the open top end to receive steel which flows into the open top end of said mold and wherein said mold has an internal periphery which continuously decreases from the open top end to the bottom end, the improvement consisting of:

said mold being formed of a first mold section located adjacent the entrance section, the internal periphery of said first mold section being reduced by a total of less than 1.9% throughout the length of said first mold section at a rate of between 0.015% and about 0.036% per centimeter of length of said first mold section, and a second mold section constituting the remainder of the mold located adjacent the first mold section and extending down to the open bottom end, the internal peripheral reduction of the seond mold section continuing at a reduced rate relative to said first mold section reduction rate and between about 0.005% and 0.015% per centimeter of length of said second mold section.

8. A mold according to claim 7, wherein in said first mold section, the total reduction of the internal periphery is from about 0.5% to about 1.1%.

9. A mold according to claim 7, wherein in said first mold section, the total reduction of the internal periphery is from about 0.56% to about 0.75%.

10. A mold according to claim 7, wherein said mold has a generally polygonal internal cross-section, wherein the walls of the first tapered section include corner facets and portions of the mold walls between the corner facets are subject to a continuous taper with the rate of reduction of the internal periphery required in the seond mold section and wherein the internal periphery of said mold adjacent the corners of the polygonal cross-section in the first mold section is progressively modified throughout the length of said first mold section to provide a higher rate of internal peripheral reduction than the rate of internal peripheral reduction that would occur without such modification of the first mold section by providing said corner facets.

11. A mold according to claim 10, wherein the modification of the internal periphery of said first mold section is accomplished by facets adjacent said corners oriented so as to increase the angles of said corners and having a width which increases progressively along the length of said first mold section, said facets being continued without further increase of width throughout the length of said second mold section.

12. A method of continuously casting steel comprising pouring molten steel into an entrance section of a substantially vertically oriented open ended tubular copper mold to establish a meniscus therein and withdrawing a casting from an exit end of the mold, the mold having an internal periphery which decreases continuously from beneath the entrance section to the exit end of the mold, the internal periphery being continuously reduced in a first than section located immediately beneath the entrance section by less that a total of 1.9% throughout the length of said first mold section at a rate of between about 0.015% and about 0.036% per centimeter of length of said first mold section and being reduced in a second mold section, constituting the remainder of the mold extending from beneath the first mold section down to the mold exit end, at a reduced rate relative to the reduction rate of said first mold section and between about 0.005% and 0.015% per centimeter of length of said second mold section and withdrawing the casting from the mold such that the internal periphery of the mold is always greater than the external periphery of the casting formed within the mold and such that the rate of contraction of the external periphery of the casting in the second mold section is less than the rate of reduction of the internal periphery of the first mold section.

* * * * *